US006511203B1

(12) United States Patent
Winther

(10) Patent No.: US 6,511,203 B1
(45) Date of Patent: Jan. 28, 2003

(54) BEACON LIGHT

(76) Inventor: John Winther, 492 Westbrook Rd., Ridgewood, NJ (US) 07450

( * ) Notice: Subject to any disclaimer, the term of this patent is extended or adjusted under 35 U.S.C. 154(b) by 0 days.

(21) Appl. No.: 09/912,738

(22) Filed: Jul. 26, 2001

(51) Int. Cl.[7] ..... F21L 4/02; F21W 111/00

(52) U.S. Cl. ..... 362/202; 362/191; 362/186; 362/184

(58) Field of Search ..... 362/190, 191, 362/186, 184, 202, 208

(56) References Cited

U.S. PATENT DOCUMENTS

| | | | | | |
|---|---|---|---|---|---|
| 4,897,768 | A | * | 1/1990 | Thul | 362/191 |
| 5,034,847 | A | | 7/1991 | Brain | 362/205 |
| 5,036,442 | A | * | 7/1991 | Brown | 362/191 |
| 5,058,900 | A | | 10/1991 | Denen | 362/119 |
| 5,280,417 | A | * | 1/1994 | Hall et al. | 362/153 |
| 5,622,423 | A | * | 4/1997 | Lee | 362/186 |
| 5,642,933 | A | | 7/1997 | Hitora | 362/243 |
| 5,653,529 | A | * | 8/1997 | Spocharski | 362/191 |
| 5,806,965 | A | | 9/1998 | Deese | 362/249 |
| 5,929,788 | A | | 7/1999 | Vukosic | 362/297 |
| 6,086,218 | A | * | 7/2000 | Robertson | 362/184 |
| 6,135,612 | A | * | 10/2000 | Clore | 362/244 |
| 6,137,396 | A | | 10/2000 | Puppo | 362/800 |
| 6,293,684 | B1 | * | 9/2001 | Riblett | 362/186 |
| 6,305,819 | B1 | * | 10/2001 | Chen | 362/191 |

* cited by examiner

*Primary Examiner*—Laura K. Tso
(74) *Attorney, Agent, or Firm*—Donald S. Cohen

(57) ABSTRACT

A beacon light includes a tubular bottom shell having a closed end and an open end. A battery housing is in the bottom shell and is adapted to contain batteries and connect them in series. A tubular, translucent light diffuser is on and secured to the open end of the bottom shell. A printed circuit board is in the light diffuser. A plurality of light emitting diodes (LEDs) are mounted on the printed circuit board and electrically connected in parallel with respect to each other. Also on the printed circuit board is a switch and a integrated circuit which are electrically connect in series with the LEDs. The printed circuit board also has battery contacts at one end which engage electrodes on the batteries in the bottom shell so as to connect the LEDs to the batteries through the switch and the integrated circuit. A switch button extends through the light diffuser and is adapted to engage the switch to operate the switch. A cap is on the top of the light diffuser.

11 Claims, 3 Drawing Sheets

BEACON LIGHT

FIELD OF THE INVENTION

The present invention is directed to a beacon light, and, more particularly, to a beacon light having light emitting diodes (LEDs) as the light source and which can be mounted in various manners for different uses.

BACKGROUND OF THE INVENTION

Beacon lights are presently used for different purposes. For example, to provide a warning light, to light up a particular area, or to provide an indication of a particular area in the dark. There are presently available various structure of beacon lights. Some such beacon lights are shown in U.S. Pat. No. 6,135,612 to William B. Clore, issued Oct. 24, 2000, entitled DISPLAY UNIT, U.S. Pat. No 5,769,532 to Hiroki Sasaki, issued Jun. 23, 1998, entitled SIGNAL WARNING AND DISPLAYING LAMP, and U.S. Pat. No. 5,594,433, to Stephen K Terlep, issued Jan. 14, 1997, entitled OMNI-DIRCTIONAL LED LAMPS. However, presently available beacon lights have various problems. Some are complex in structure and are therefore difficult and expensive to manufacture. Some, by their structure, are limited in the manner that they can be used. Therefore, it would be desirable to have a beacon lamp which is relatively simple in structure and therefore relatively inexpensive, and which can be used in various manners.

SUMMARY OF THE INVENTION

A beacon light includes a tubular bottom shell having a closed bottom and an open top. Within the bottom shell is means for supporting batteries. A tubular light diffuser of a translucent material is mounted on the open end of the bottom shell. A plurality of LEDs are mounted in the light diffuser and means are in the light diffuser for electrically connecting the LEDs to the batteries to allow the LEDs to be turned off and on. A cap is on the top of the light diffuser.

DETAILED DESCRIPTION OF PREFERRED EMBODMENT

Figure 1:
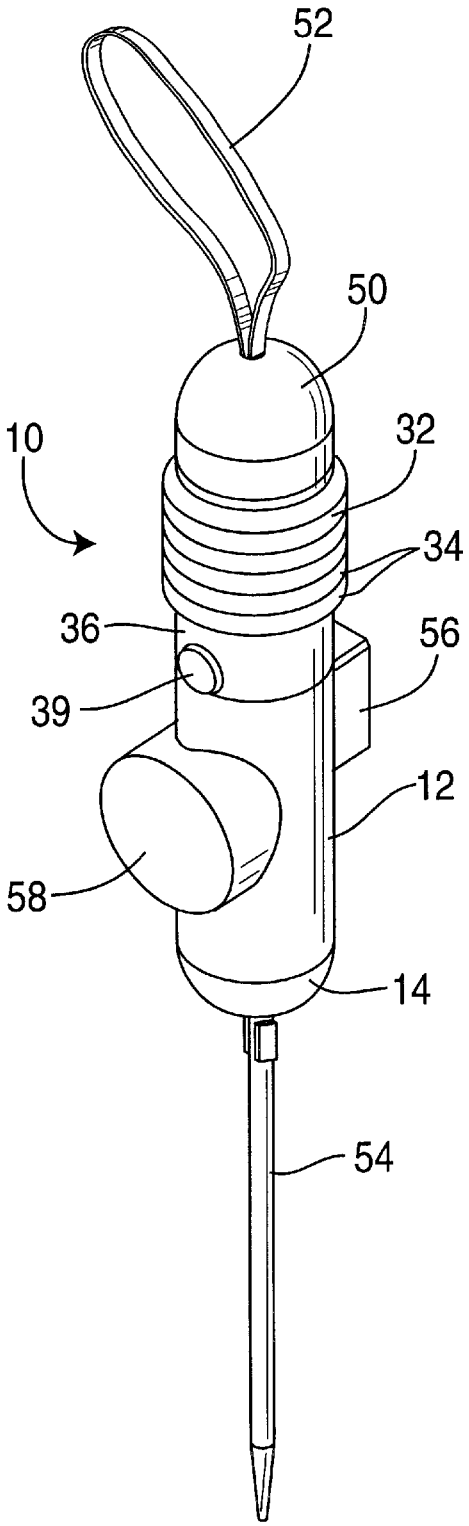
FIG. 1 is a perspective view of the beacon of the present invention.
Figure 2:
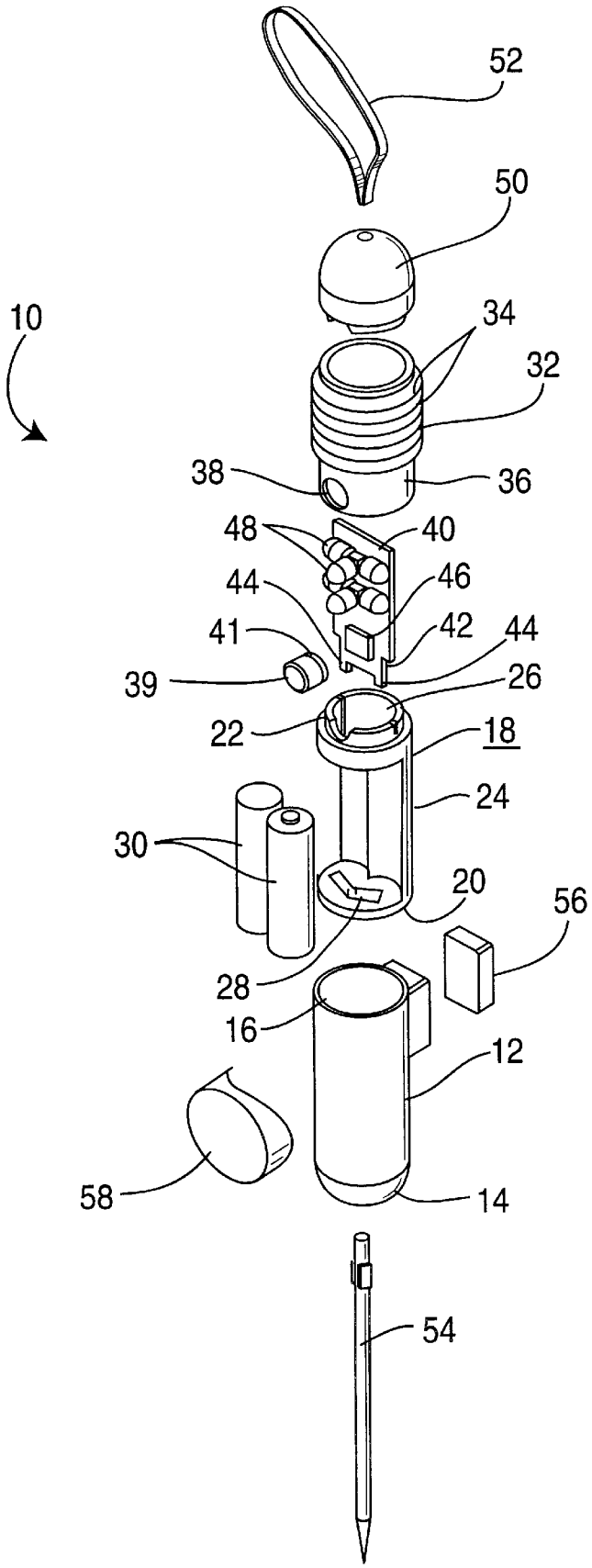
FIG. 2 is an exploded view of the beacon.

Referring to FIGS. 1 and 2, the beacon light of the present invention is generally designated as 10. Beacon light 10 comprises a tubular bottom shell 12, preferably of plastic, having a closed bottom 14 and an open top 16. A battery housing 18 fits into the bottom shell 12. The battery housing 18 has a flat, circular bottom 20, a flat circular top 22 and a semi-cylindrical outer wall 24 extending between and secured to the bottom 20 and the top 22. The top 22 has an opening 26 therethrough. A leaf spring 28 is secured to the top surface of the bottom 20 with upstanding ends. The battery housing 18 is adapted to hold two batteries 30, each of which is seated on a separate end of the leaf spring 28 with an electrode of the battery contacting the leaf spring 28.

Thus, the batteries 30 are electrically connected in series. The electrodes of the batteries 30 at the other end thereof are exposed through the opening 26 in the top 22.

A tubular light diffuser 32 is mounted on and secured to the top 16 of the bottom shell 12. The light diffuser 32 is of a light translucent material, such as a plastic, and is preferably of a color, such as red. The light diffuser 32 has a plurality of annular, V-shaped ribs 34 projecting therefrom and extending around the upper portion thereof. The lower portion 36 of the light diffuser 32 has a cylindrical outer surface and a hole 38 extends therethrough. A switch button 39 extends through the hole 38. The switch button 39 has a radially outwardly extending flange 41 at its back end which is within the light diffuser 32 and prevents the switch button 39 from passing completely through the hole 38.

Figure 3:
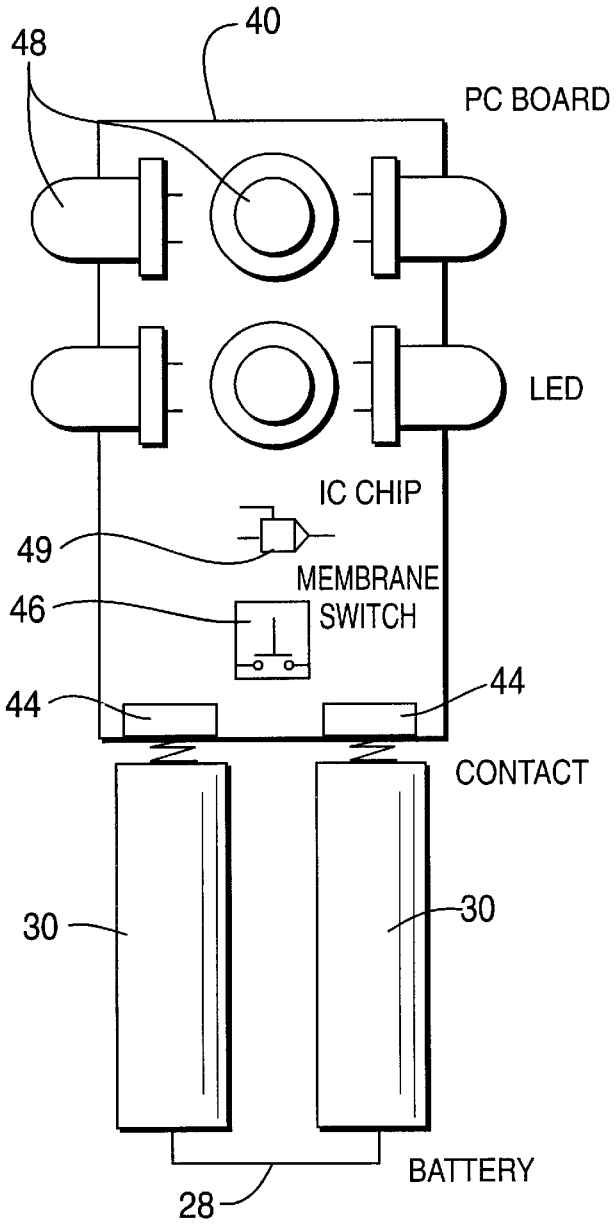
FIG. 3 is a schematic view of the printed circuit board used in the beacon of the present invention.

A flat, substantially rectangular printed circuit board 40 is adapted to fit in the light diffuser 32. The printed circuit board 40 has a narrower tab 42 at its bottom end which is adapted to extend through the opening 26 in the top 22 of the battery housing 18. A pair of spaced battery contacts 44 are on the end of the tab 42 and are each adapted to contact an electrode of a separate battery 30. A membrane switch 46 is mounted on the lower portion of the printed circuit board 40 and is positioned to be in alignment with the hole 38 in the lower portion 36 of the light diffuser 32 so as to be contacted by the switch button 39. A plurality of light emitting diodes (LEDs) 48 are mounted on the printed circuit board 40. As shown in FIG. 3, an integrated circuit (IC) 49 is mounted on the printed circuit board 40. The IC 49 serves to control the type of light emitted by the LEDs, such as a continuous, steady light or a flashing light. The IC 49 can also control the frequency of any flashing light. The printed circuit board 40 has thereon electrical conductors (not shown) which electrically connect the LEDs, membrane switch 46, IC 49 and battery contacts 44 in a manner which will be described. The electrical conductors are formed on the printed circuit board 40 in any manner well known in the art.

A cap 50 fits in the open top end of the light diffiser 32 and is secured thereto to close the light diffuser 32. A strap 52 is secured to the cap 50 to allow the beacon light 10 to be carried thereby. A ground spike 54 has one end which can be removably secured in an hole (not shown) in the bottom end 14 of the bottom shell 12. The other end of the spike 54 has a sharp point to allow it to be pressed into the earth and allow the beacon light 10 to be secured in an upright position on the earth. A magnet 56 is mounted on the bottom shell 12 to allow the beacon light 10 to be mounted on a metal post or a metal strip on a wall. A suction cup 58 is also secured on the bottom shell 12 to allow the beacon light to be mounted in another manner.

Figure 4:
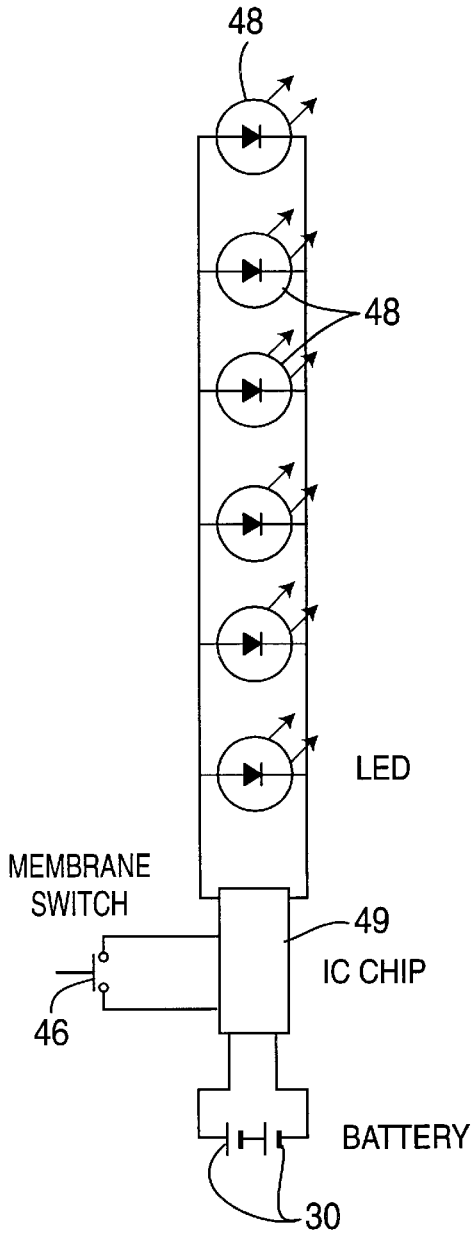
FIG. 4 Is a schematic view of the electrical circuit of the beacon of the present invention.

As shown in FIG. 4, the LEDs 48 are connected in parallel with each other, and are connected to the IC 49. The membrane switch 46 is also connected to the IC 49. The IC 49 is connected across the batteries 30. Thus, the switch 46 serves to turn the circuit on and off. Pressing on the switch button 39 to bring it into contact with the switch 46 can connect the LEDs 48 across the batteries 30 through the IC 49 to turn the LEDs 48 on and thereby emit light from the beacon 10. The first pressing of the switch button 39 may provide a steady, continuous light from the LEDs. Pressing the switch button 39 again may operate the IC 49 to provide a flashing light. Additional presses of the switch button 39 may vary the frequency of the flashing light. Finally, another press on the switch button 39 may disconnect the LEDs 48 from the batteries 30 and thereby turn the light off.

Thus, there is provided by the present invention a beacon light 10 which is relatively simple in structure so that it can be made easily and inexpensively. Also, the beacon light 10 of the present invention can provide either a steady continuous light or a flashing light and the frequency of the flashing light can be varied. In addition, the beacon light 10 has various means, such as the ground spike 54, strap 52 and magnet 56 for mounting the beacon in various manners.

What is claimed is:

1. A beacon light comprising:

tubular bottom shell having a closed bottom and an open top;

means in said bottom shell for supporting batteries;

a tubular light diffuser of a translucent material mounted on the open end of the bottom shell;

a flat substantially rectangular printed circuit board in said light diffuser;

a plurality of light emitting diodes (LEDs) mounted on the printed circuit board and electrically connected together;

means in said light diffuser for electrically connecting said LEDs to batteries in the bottom shell;

a switch mounted on the printed circuit board and electrically connected to the LEDs and a button extending through a hole in the light diffuser and adapted to engage the switch to turn it off and on, and a cap on the top of the light diffuser.

2. The beacon light in accordance with claim 1 further comprising a pair of battery contacts on the bottom edge of the printed circuit board and electrically connected to the LEDs through the switch, said contacts being adapted to contact electrodes of batteries in the bottom shell to electrically connect the LEDs to the batteries.

3. The beacon light in accordance with claim 2 further comprising an integrated circuit on said printed circuit board and electrically connected between the switch and the LEDs to control the light emitted from the LEDs.

4. The beacon light in accordance with claim 3 further comprising a battery housing in said bottom shell, said battery housing having a circular bottom, a circular top and a semi-cylindrical wall extending between and connected to the top and bottom, the battery housing adapted to hold the batteries which are mounted along the wall between the top and bottom.

5. The beacon light in accordance with claim 4 further comprising spring contacts on the bottom the battery housing, the batteries adapted to be seated on the spring contact with the electrodes of the batteries contacting the spring electrodes to electrically connect the batteries in series.

6. The beacon light in accordance with claim 5 in which the top of the battery housing has an opening therethrough and the end of the printed circuit board extends through the opening the top of the battery housing so that the battery contacts on the printed circuit board engage electrodes on the batteries.

7. The beacon light in accordance with claim 6 in which the light diffuser has a plurality of V-shaped ribs projecting from its outer surface, said ribs being at upper part of the light diffuser, and the lower part of the light diffuser has a cylindrical surface with a hole in the lower part of the light diffuser which is in alignment with the switch on the printed circuit board.

8. The beacon light in accordance with claim 1 further comprising a ground spike secured to and extending from the closed bottom of the bottom shell, the spike having a pointed end to allow it to be inserted into the ground.

9. The beacon light in accordance with claim 1 further comprising a flexible strap secured to the cap.

10. The beacon light in accordance with claim 1 further comprising a magnet secured to the bottom shell.

11. The beacon light in accordance with claim 1 further comprising a suction cup secured to the bottom shell.

* * * * *